US005582109A

United States Patent [19]

Levi et al.

[11] Patent Number: 5,582,109

[45] Date of Patent: Dec. 10, 1996

[54] DOUBLE-ACTING CLAMP FOR COUPLING A FUNICULAR VEHICLE TO THE RUNNING CABLE

[75] Inventors: Ferruccio Levi, Cologno Monzese; Giuseppe Conte, Bolzano, both of Italy

[73] Assignee: Leitner S.p.A., Bolzano, Italy

[21] Appl. No.: 491,585

[22] Filed: Jun. 16, 1995

[30] Foreign Application Priority Data

Jun. 16, 1994 [IT] Italy ..... MI94A1255

[51] Int. Cl.[6] ..... B61B 12/00

[52] U.S. Cl. ..... 104/173.1; 104/209; 104/220

[58] Field of Search ..... 104/173.1, 178, 104/202, 204, 205, 206, 207, 209, 214, 215, 217, 218, 219, 220, 221, 229

[56] References Cited

U.S. PATENT DOCUMENTS

| | | | |
|---|---|---|---|
| 4,403,552 | 9/1983 | Kuczynski | 104/204 |
| 4,653,406 | 3/1987 | Levi | 104/209 |
| 4,686,906 | 8/1987 | Meindl | 104/209 |
| 5,111,751 | 5/1992 | Zlotek | 104/209 |

FOREIGN PATENT DOCUMENTS

| | | | |
|---|---|---|---|
| 0461098 | 12/1991 | European Pat. Off. . | |
| 2548615 | 1/1985 | France | 104/173.1 |
| 2656579 | 7/1991 | France . | |
| 161554 | 7/1905 | Germany . | |
| 207892 | 8/1959 | Germany | 104/204 |
| 1131718 | 6/1962 | Germany . | |

*Primary Examiner*—Mark T. Le

*Attorney, Agent, or Firm*—Oblon, Spivak, McClelland, Maier & Neustadt, P.C.

[57] ABSTRACT

A double-acting clamp for coupling a funicular vehicle to a running cable wherein in order to reduce the overall size as much as possible, a clamp has jaw operating arms substantially perpendicular to the jaws of each arm and said jaw operating arms define a space within which both an elastic mechanism and the operating arms for the elastic mechanism are housed.

16 Claims, 8 Drawing Sheets

DOUBLE-ACTING CLAMP FOR COUPLING A FUNICULAR VEHICLE TO THE RUNNING CABLE

BACKGROUND OF THE INVENTION

1. Field of the Invention

This invention relates to a double-acting clamp for coupling a funicular vehicle to the running cable.

2. Discussion of the Background

European patent application No. 0 461 098 describes a double-acting clamp mounted on a funicular rail vehicle.

To achieve secure and advantageous engagement and disengagement of the clamp jaws with and from the running cable, the movement of the cable during these operations must be in a vertical plane. The clamp described in said patent application is therefore mounted on its vehicle such that the jaws and the running cable interact by moving relative to one another in a vertical direction. However, because of the structure of said clamp the stated condition is satisfied only if it is mounted on the vehicle such that the axis along which the elastic means act is vertical to the vehicle. In such a position the clamp operates under the best operating conditions but occupies a space, in particular in terms of height, which it would be desirable to have reduced much as possible in order to achieve the following for equal vehicle capacity:

lesser vertical vehicle height;

improved arrangement of the vehicle mechanical members;

improved arrangement of those line members which have to operate in the vicinity of the clamp.

SUMMARY OF THE INVENTION

The object of the present invention is therefore to provide a double-acting clamp which can be installed on the vehicle in such a manner that the jaws and running cable engage and/or disengage by moving relative to each other in a vertical direction, while tending to be a small size, particularly in the vertical direction.

The arrangement of the jaws relative to their operating arms and the hinging of the latter by a single hinge has enabled the vertical dimensions to be substantially reduced. However to prevent the space saved in the vertical direction resulting in a corresponding loss of horizontal space, elastic means have been housed between the jaw operating arms, hence also limiting the horizontal dimensions.

The operating guides for the jaw carrier arms, which represent line members, are therefore positioned on only one side of the line with respect to the running cable. A single element can therefore be used for forming said guides, leading to substantial constructional simplification. Mounting of the element forming the operating guides for the jaw carrier arms is hence also simplified.

BRIEF DESCRIPTION OF THE DRAWINGS

The invention is illustrated by way of non-limiting example in the figures of the accompanying drawings.

BRIEF DESCRIPTION OF THE DRAWINGS

Figure 1:
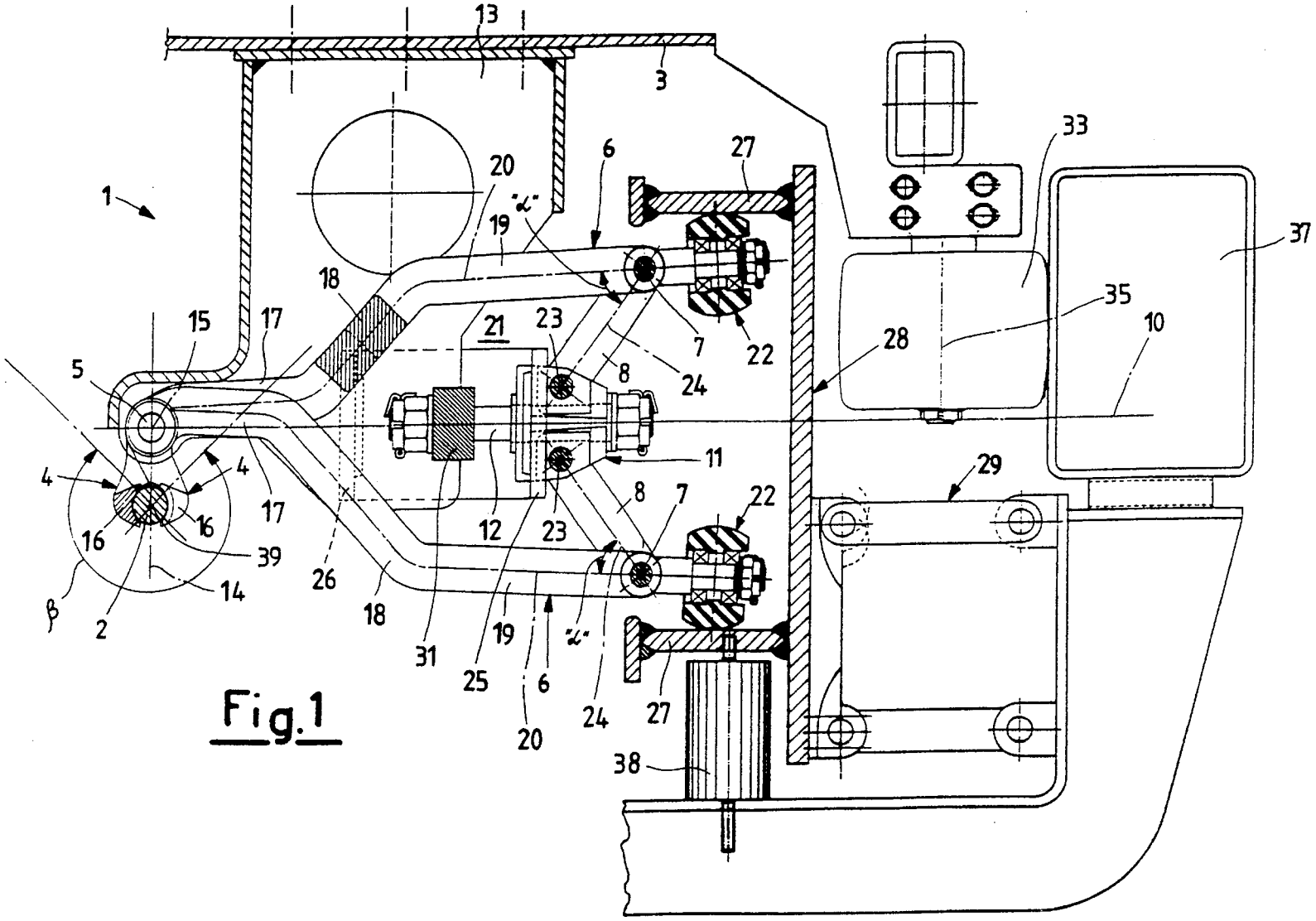
FIG. 1 is a sectional view taken through a clamp according to the invention mounted on a funicular rail vehicle and shown in its closed position but just about to open.

With reference to the aforesaid figures and in particular to FIGS. 1–4, the clamp of the invention, indicated overall by 1, is of the double-acting type and is used to couple the funicular rail vehicle 3 with which it is associated to the running cable 2. The clamp 1 comprises substantially a pair of jaws 4, a first hinge 5, a pair of jaw operating arms 6, a pair of second hinges 7, a pair of operating arms 8 for elastic means, a pair of springs 9 positioned parallel to an axis 10, an element 11 able to slide on a guide 12, and a box structure The jaws 4 comprise hooks 16 with a circular profile of diameter essentially equal to that of the running cable 2 against which they are to grip.

The jaws extend along an axis 14 which is essentially perpendicular to that, indicated by 10, parallel to which the elastic means act.

The jaws 4 are perpendicularly joined to their operating arms 6 at the second end of these latter where there is positioned the first hinge 5, the axis 15 of which is therefore approximately perpendicular both to the axis 10 and to the axis 14.

The fact that the jaws 4 are perpendicular to their operating arms 6 enables the size of the clamp in the direction perpendicular to the axis 10 to be substantially reduced.

For reasons of solidity and amplification of the force produced by the springs 9, the length of the jaws along the axis 14, ie the distance of the hooks 16 from the first hinge 5, is reduced to a minimum. The first hinge 5 is rigid with the box structure 13, which is rigidly fixed to the vehicle 3 by bolts 40 engaging the holes 30. The jaw operating arms 6 essentially comprise three rectilinear portions 17–19, which are of rectangular cross-section for size and strength reasons and are positioned along an axis 20 which curves in two opposing directions. In this manner the jaw operating arms 6 define between them a space 21 within which the operating arms 8 for the elastic means, the sliding element the guide 12 and the elastic means or springs 9 are housed. This arrangement therefore also enables the clamp dimension along the axis 10 to be essentially limited to the necessary length of the arms 6. The first ends of said arms 6 carry bearings 22, preferably of rolling-contact type, to reduce friction between said first ends and a pair of opposing operating guides 27 forming part of the funicular line. To avoid the use of lubricant on the guides 27 the bearings 22 are preferably of rolling-contact type and have their outer ring of synthetic material to provide more silent operation. The operating arms 8 for the elastic means are hinged to the arms 6 at the first end of these latter by the second hinges 7, and are hinged to the sliding element 11 by third hinges 23.

The angles α formed by the intersection of the axes 20 of the arms 6 and the axes 24 of the arms 8 at the hinges 7 are acute, with their concavity facing the interior of the space 21 defined between the jaw operating arms. In the particular embodiment illustrated, the operating arms 8 for the elastic means are two in number for each arm 6. The sliding element 11 comprises a movable thrust plate 25 opposing a fixed thrust plate 26 rigid with the box structure 13. The four arms 8 are hinged to the movable thrust plate 25. This configuration results in the best balanced distribution of the mechanical forces.

The two springs 9 are housed precompressed between the two thrust plates 25 and 28 parallel to the axis 1 0, and are preferably of the helical type operating by further compression between said two plates 25 and 26. The guide 12 positioned on the axis 10 is fixed at 31 to one end of the box structure 13.

The illustrated clamp is of the type commonly known as "without dead center", ie a clamp which closes spontaneously when the action of the guide 27 on the bearings 22 ceases. However, by simply varying the measurements of its constituent linkages a similar clamp of the "with dead center" type can be obtained, ie a clamp which for its closure must be acted upon by an action opposite to that which has caused it to open. Essentially the existence of one or the other constructional type depends on the distance of the axis of the hinge 5 from the point of intersection of the axes 24 with the axis 10.

For safety reasons it is preferable to provide each funicular vehicle 3 with at least two clamps 1, each of which is secured to one of the two frames 36 situated at the two ends of the vehicle 11. Each clamp 1 is hence positioned between the pairs of wheels 32 of horizontal axis 34 and the pair of wheels 33 of vertical axis 35, which run along the rails 37.

The operation of the clamp 1 is as follows.

Figure 2:
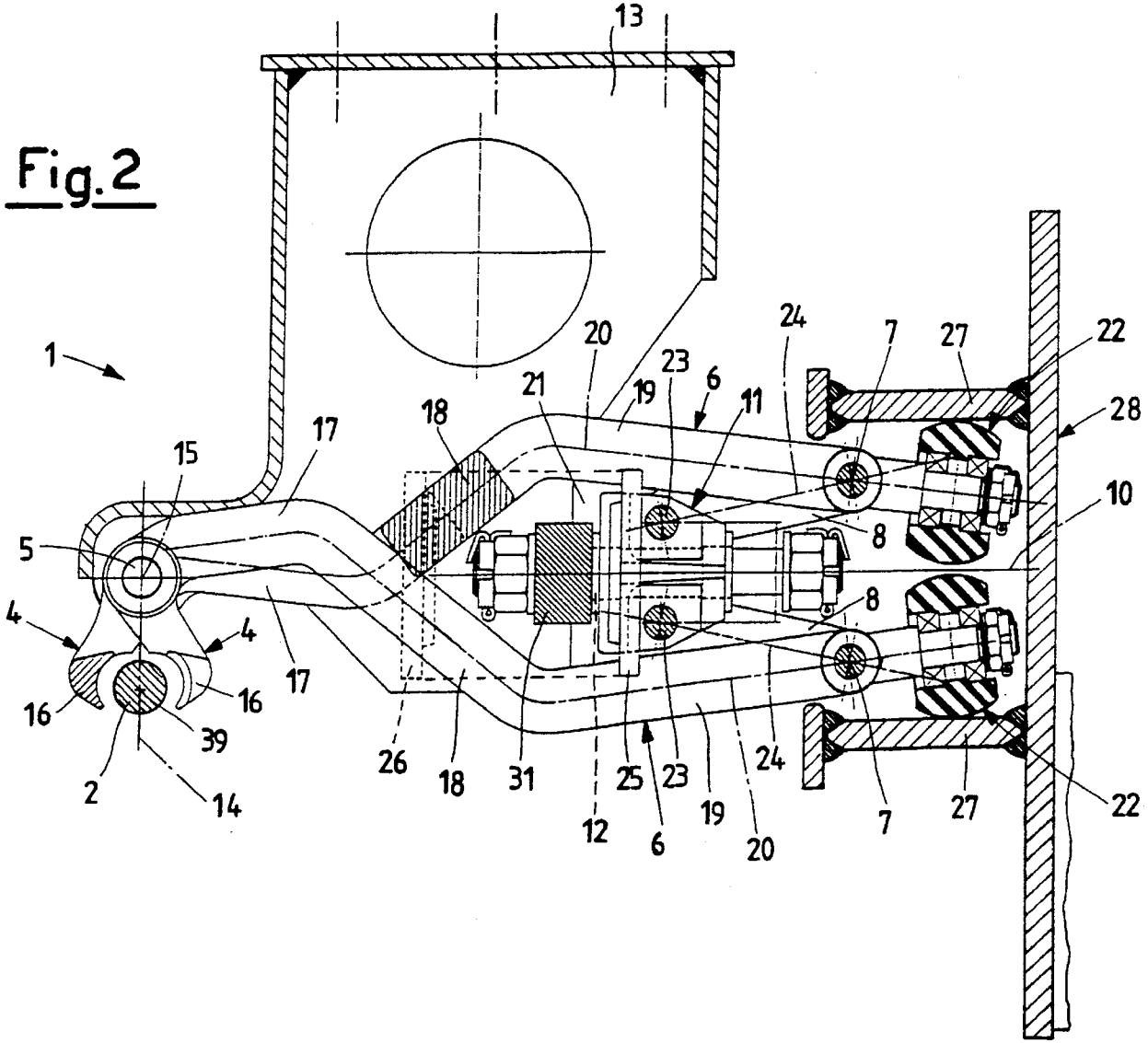
FIG. 2 is a sectional view showing the clamp in its open position.
Figure 3:
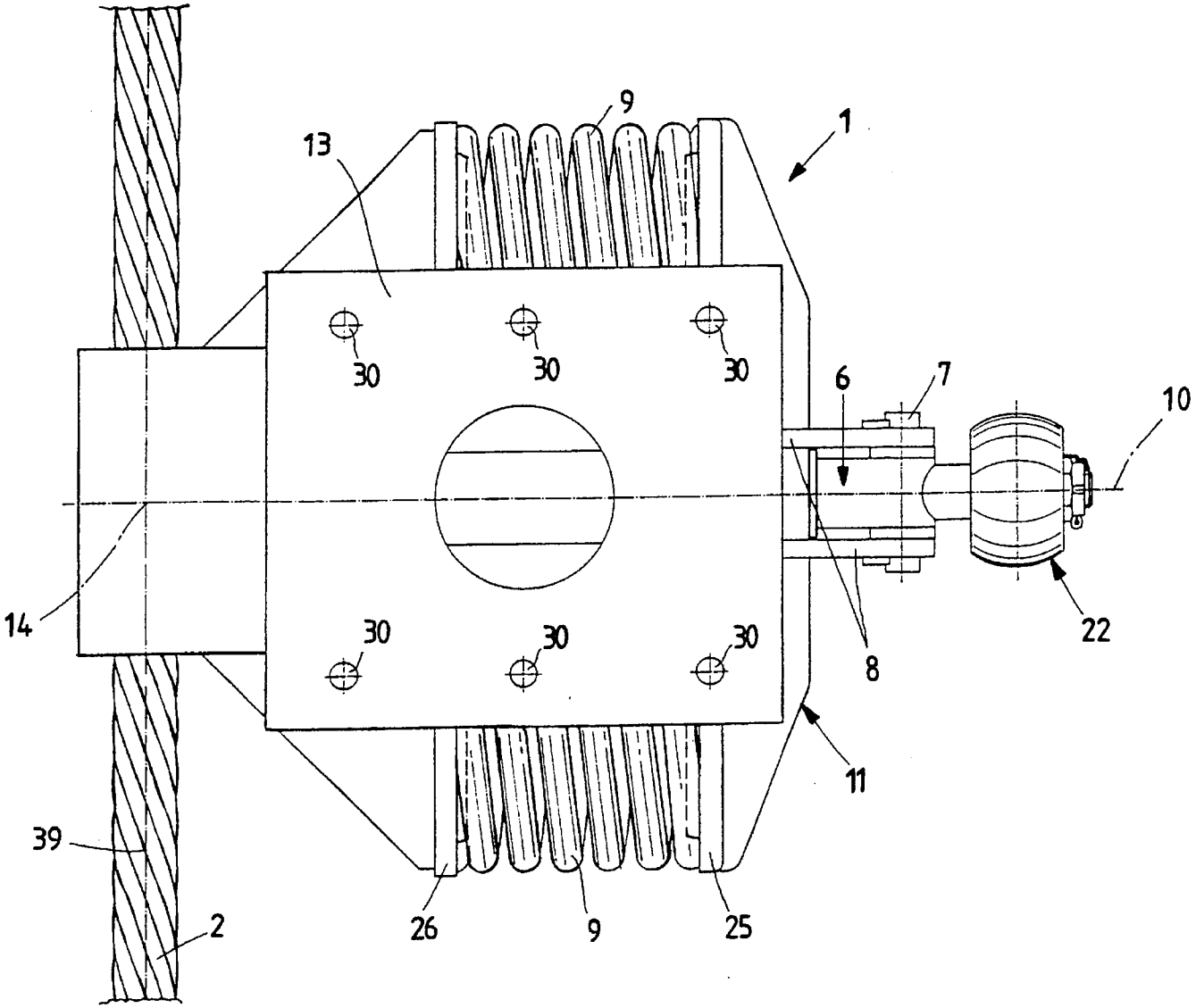
FIG. 3 is a plan view of the clamp.
Figure 4:
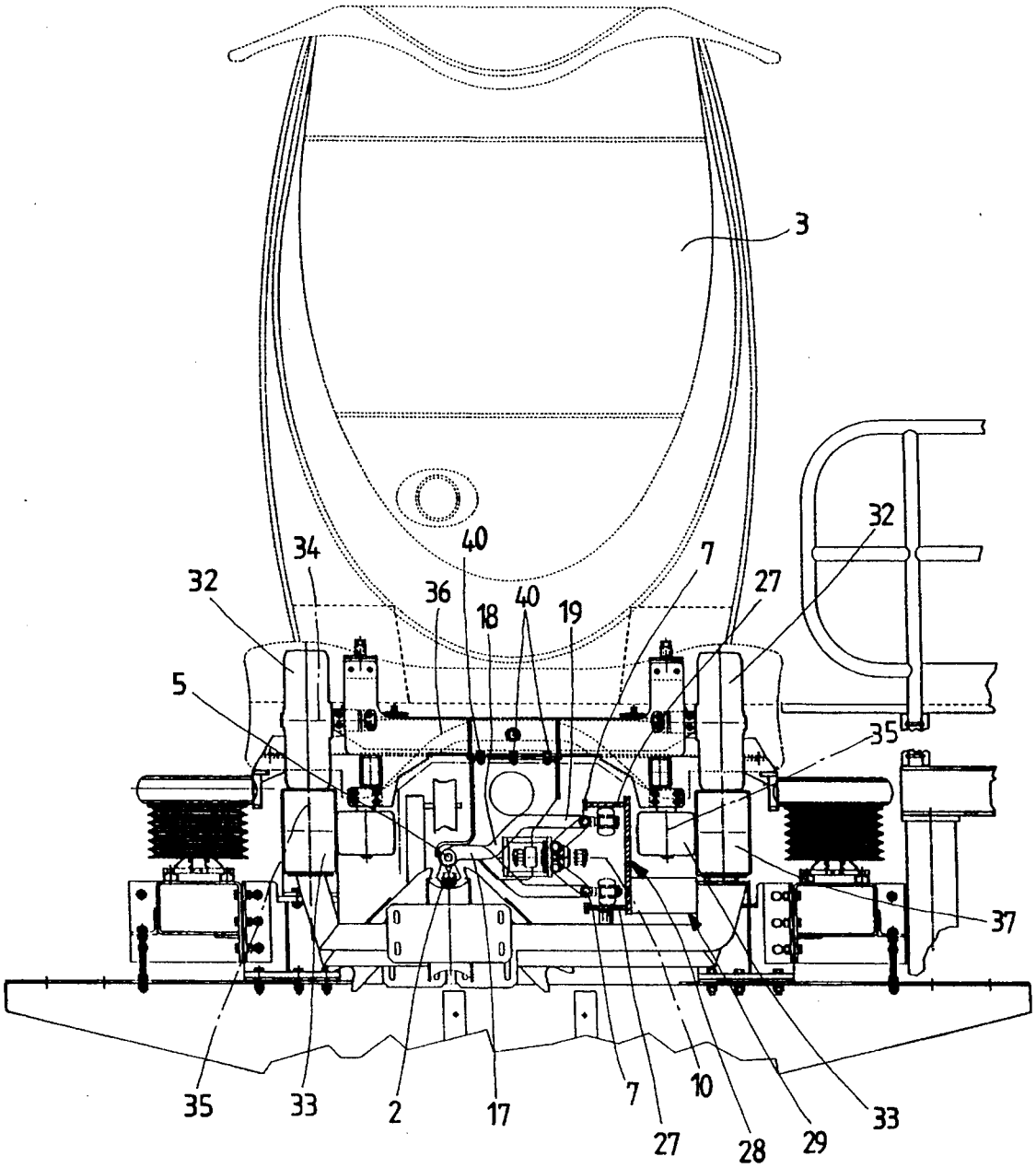
FIG. 4 is a cross-section through a funicular rail vehicle provided with the clamp of the invention shown during its released state from the running cable.
Figure 5:
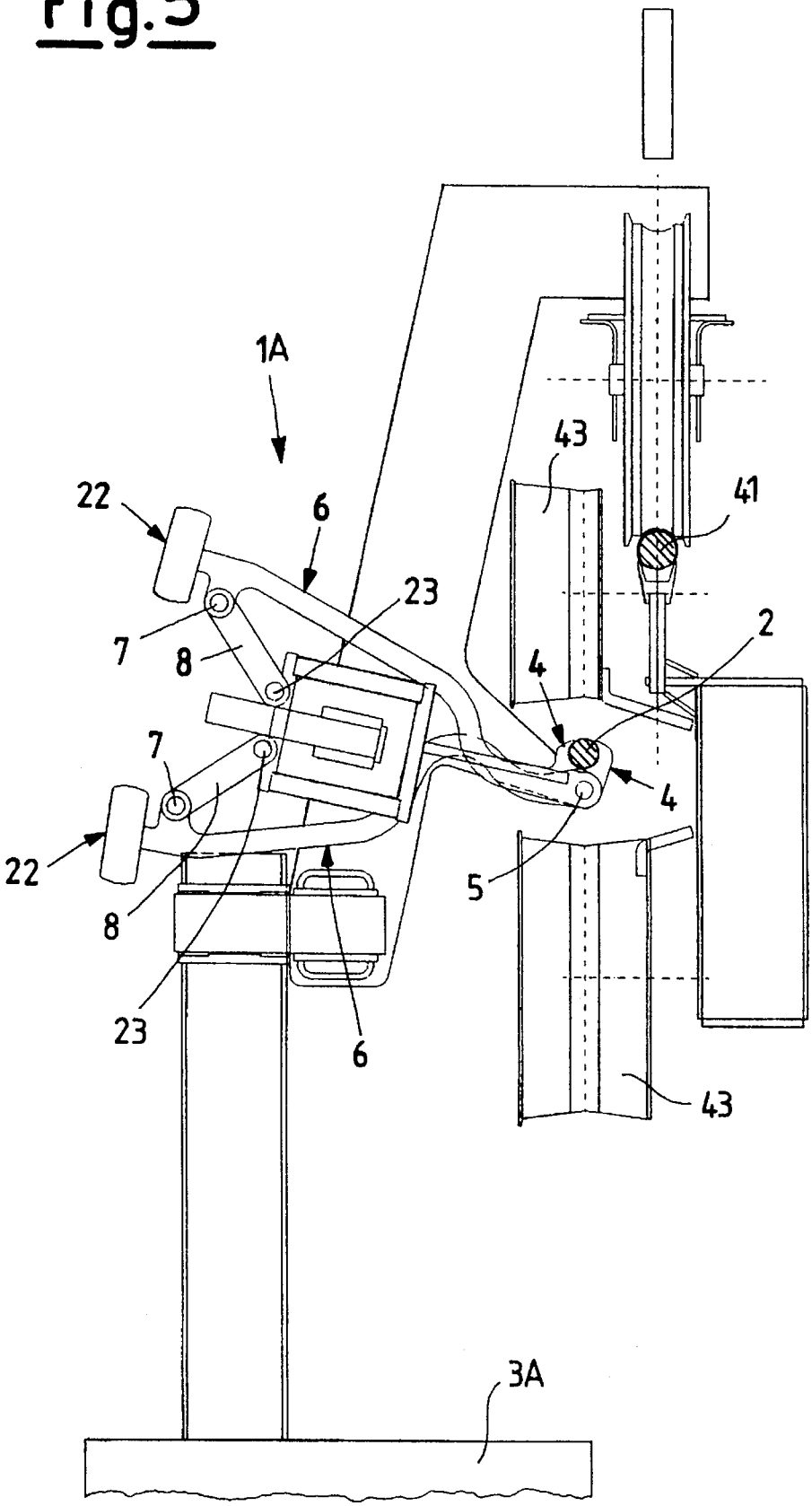
FIG. 5 is a schematic view of a clamp according to the invention applied to an aerial funicular vehicle and shown in the closed position normally assumed during vehicle travel.
Figure 6:
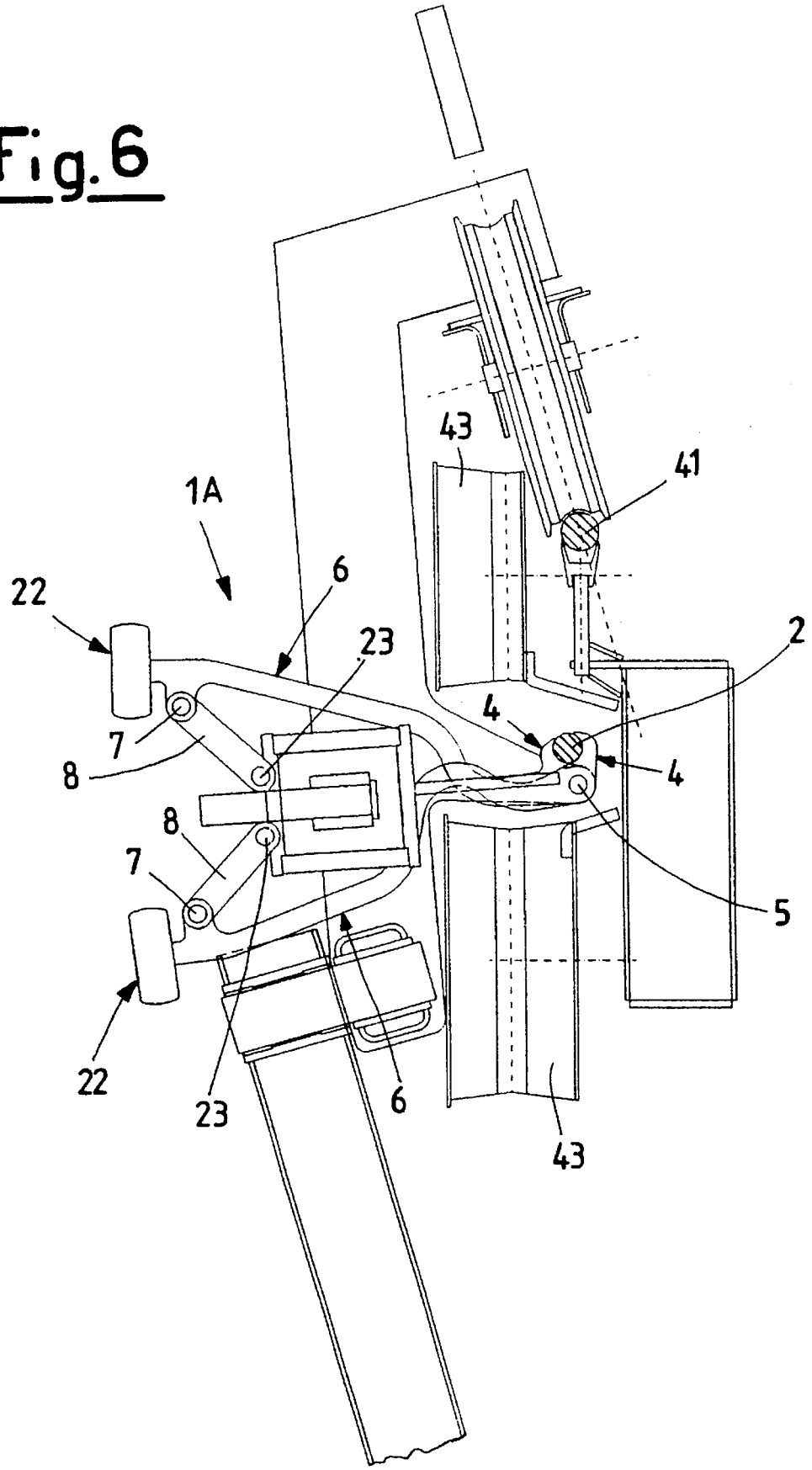
FIGS. 6 and 7 are views corresponding to the preceding in which the funicular vehicle is shown in two opposing positions, swung about the running cable, which are normally assumed by the vehicle in the case of a lateral wind being applied to the vehicle.
Figure 7:
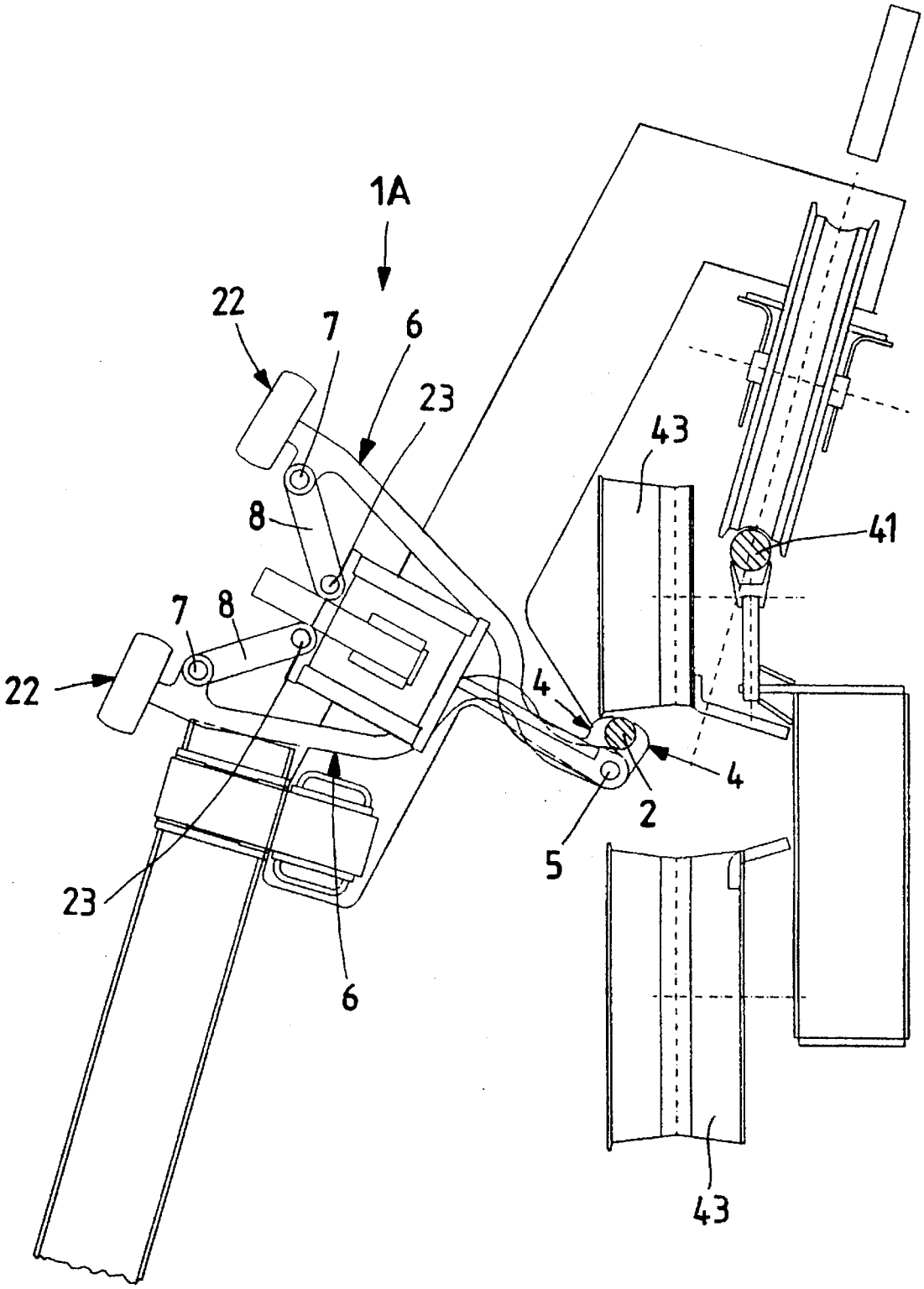
Figure 8:
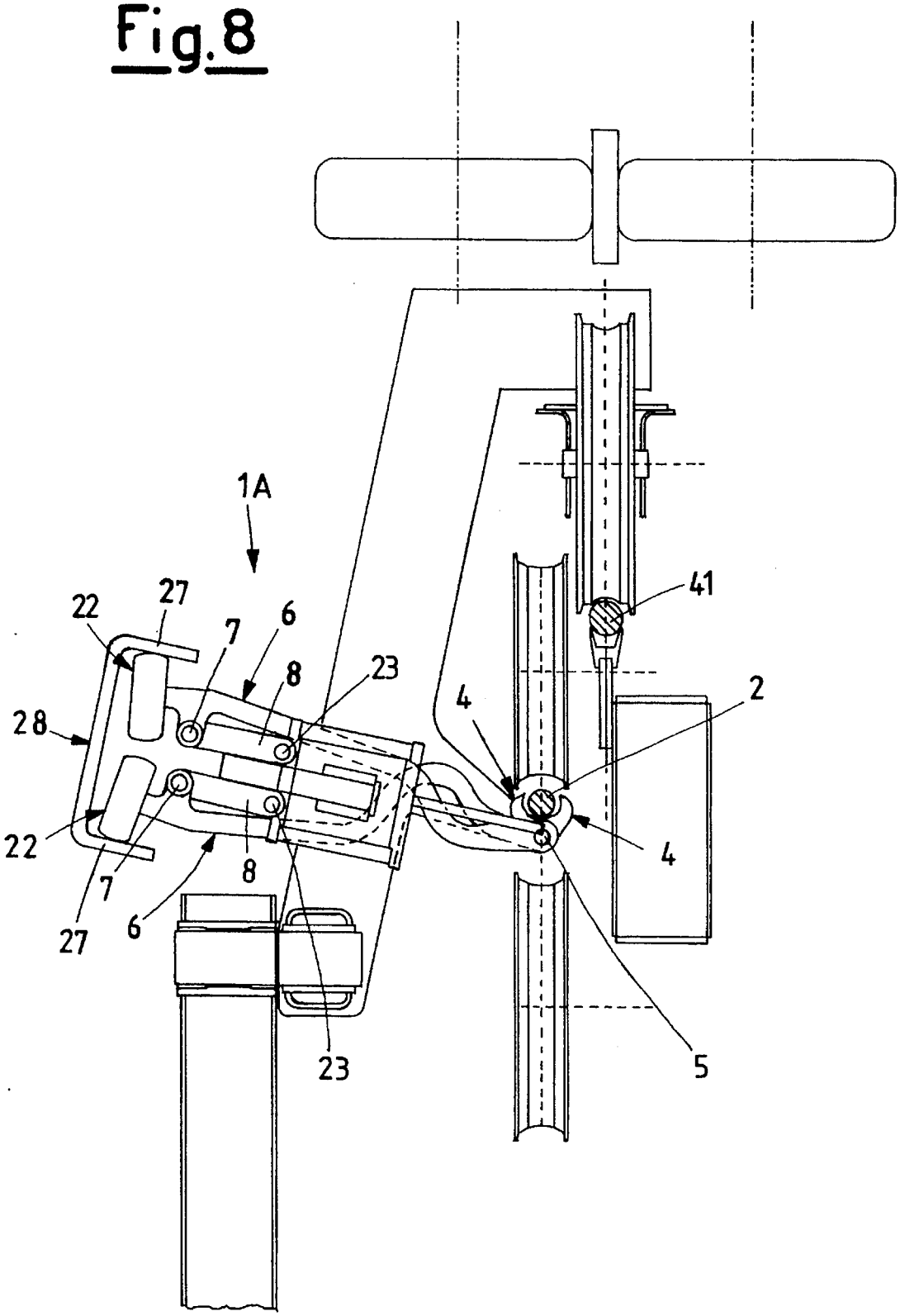
FIG. 8 is a schematic view of the clamp of FIG. 5 in its position of maximum opening, which is normally assumed when the funicular vehicle passes through a station.

The clamp 1 is normally closed and hence assumes the configuration shown in FIG. 1. The funicular vehicle 3 is coupled to the running cable 2. The hooks 16 of the jaws 4 grip the running cable 2 with a force due to the precompression of the springs 9. When the bearings 22 encounter the pair of operating guides 27 the opening operation commences, imposed by the progressive convergence of said guides along the funicular line section where they are provided, for example in a station. During this opening, the springs 9 undergo further squeezing or compression. The maximum opening configuration of the clamp is shown in FIG. 2. The funicular vehicle 3 is disengaged from the running cable 2. As is well known, double-acting clamps, ie those in which both the jaw-carrying arms can rotate about the pins of their connection hinge, are preferred because of their effectiveness and quick action; however, said advantages can be exploited to the full only if the jaw carrier arms are effectively operated simultaneously and with the same force. Only in this case is correct passage of the cable 2 for movement in the direction of the axis 14 ensured without also requiring transverse displacement of the vehicle or of the cable in order to prevent said cable interfering with the hooks 16 of the jaws 4. This condition is more easily satisfied if the pair of operating guides 27 forms part of a single element such as that indicated by 28. This is made possible because the first ends of the arms 6 of the clamp 1 lie on the same side of the running cable 2 when the clamp has been mounted on the vehicle. The clamp of the invention has therefore the appreciable advantage of being able to be associated with operating guides which are positioned or formed on a one-piece element and are hence particularly effective because said one-piece element can be easily positioned along the line such that the guides are equidistant from the clamp axis 10 to hence provide the same and simultaneous effect on both operating arms for the clamp jaws. In addition, in order to still better satisfy the aforesaid condition, the guide element carrier 28 can be associated with articulated quadrilaterals 29 (only one of which is visible in the figures). This would not be possible if the guides 27 formed part of separate elements. In this respect, by supporting the guide element carrier 28 by articulated parallelograms 29 the aforesaid condition of equidistance is always satisfied in the best possible manner independently of the inevitable variations in the position of the clamp relative to the funicular line due for example to the state of loading of the funicular vehicle 3. Said equidistant condition is also sure to be maintained during the entire operating period of the clamp 1, independently of the degree of convergence of the pair of guides 27 along the element 28. The clamp 1 of the present invention therefore enables the aforesaid advantages to be obtained by applying the parallelograms 29 to the element 28, and which would not be obtainable (or only with structural complications) if the guides 27 were necessarily on separate elements positioned on opposite sides of the running cable 2.

The aforesaid is also achieved by virtue of the fact that at least one elastic damper element 38 can be associated with the element 28 to eliminate any undesirable vibration which could arise during the engagement of the clamp 1 with the element 28.

It should be noted that notwithstanding all those elements which together provide the aforesaid technical characteristics, the jaws 4 of the clamp 1 still have enough free space about them for housing cable guide rollers, which subtend an angle β of more than 270°. This free space can also be advantageously used for further service means for the funicular system.

The box structure 13 can be shaped at the hinge 5 such as to create a further free space usable for housing cable guide rollers on the opposite side to that on which the cable 2 leaves the jaws 4.

As is clearly visible in FIGS. 5–8, by virtue of the aforesaid characteristics the clamp of the invention can also be advantageously applied to an aerial funicular vehicle 3A, or to a funicular vehicle in which the support and guide means previously represented by the rail 37 now consist of at least one load-bearing cable 41. The advantages already described for the embodiment shown in FIGS. 1–4 also apply to the embodiment shown in FIGS. 5–8. In these figures, elements corresponding to those shown in the preceding figures carry the same reference symbols. The exception to this are the clamp and the vehicle, which are indicated by 1A and 3A respectively. It should be especially noted that because of its particular shape the clamp 1A can operate satisfactorily between the rollers 43 supporting the running cable 2 without interfering with them, even if these are relatively close together and hence in the optimum position for supporting the running cable 2. This facility for using the same clamp on two different types of funicular vehicle contributes to reducing the number of components, so reducing manufacturing costs. The dimensions of the constituent members of the illustrated clamp 1A are such as to make it a "dead center" type. Consequently when the action of the pair of guides 27 which have caused it to open ceases, the clamp does not close automatically. To close the clamp 1A it is therefore necessary to act on it with a force opposite that which caused it to open.

Preferably the opening is achieved by guides which wedge between the jaw operating arms 6 causing them to diverge.

Again in this case, as in the preceding, the guide element carrier 28 can be associated with an articulated parallelogram, damped or not, which is very useful in achieving optimum operation of the clamp or clamps of each vehicle.

Obviously, numerous modifications and variations of the present invention are possible in light of the above teachings. It is therefore to be understood that within the scope of the appended claims, the invention may be practiced otherwise than as specifically described herein.

We claim:

1. A double-acting clamp coupling a funicular vehicle to a running cable, comprising;

a pair of jaw operating arms arranged about an axis of symmetry;

a second pair of operating arms respectively hinged at a first end thereof to said jaw operating arms;

elastic means connected to and operated by said second pair of arms said jaw operating arms having first and second ends and being hinged at said second end thereof to the funicular vehicle;

and jaws located respectively at said second ends of said jaw operating arms, said jaws counteractingly cooperating with and gripping the running cable (2) wherein:

the jaw operating arms are connected together at said second ends thereof by a single hinge;

the jaw operating arms bound a space which houses the elastic means and the operating arms;

a pair of opposing guides are provided which are connected with said first ends of said jaw operating arms wherein the jaw operating arms include at the first ends thereof bearings reducing friction when said first ends respectively interact with said pair of opposing guides;

the jaws extend along an axis substantially perpendicular to the axis of symmetry;

the operating arms have the first ends thereof hinged to the first ends of the jaw operating arms and form an acute angle with a concavity thereof facing an interior portion of the space defined by said jaw operating arms (6); and the operating arms have the second ends thereof hinged to an element slidable axially on at least one additional guide and act on said elastic means, said elastic means operating parallel to the axis of said additional guide.

2. A clamp as claimed in claim 1, which comprises a box structure fixed to the funicular vehicle wherein both the single hinge and the guide are fixed to said box structure.

3. A clamp as claimed in claim 2, wherein the elastic means comprises two precompressed helical springs positioned between a fixed thrust plate connected with the box structure and a movable thrust plate positioned on the sliding element, the at least one additional guide for the slidable element being positioned between and parallel to said springs.

4. A clamp as claimed in claim 1, wherein the operating arms for the elastic means are respectively provided for each jaw operating arm.

5. A clamp as claimed in claim 1, wherein said bearings located at the first ends of the jaw operating arms comprise rolling contact bearings.

6. A clamp as claimed in claim 1, wherein the jaw operating arms each have a rectangular cross-section.

7. A clamp as claimed in claim 1, wherein the funicular vehicle comprises a rail vehicle.

8. A clamp as claimed in claim 1, wherein the funical vehicle comprises an aerial funicular vehicle.

9. A double-acting clamp coupling a funicular vehicle to a running cable, comprising:

a pair of jaw operating arms arranged about an axis of symmetry;

a second pair of operating arms respectively hinged at a first end thereof to said jaw operating arms;

an elastic mechanism connected to and operated by said second pair of operating arms, said jaw operating arms having first and second ends and being hinged at said second end thereof to the funicular vehicle and jaws located respectively at each of said second ends of said jaw operating arms, said jaws counteractingly cooperating with and gripping the running cable wherein:

the jaw operating arms and are connected together at said second ends thereof by a single hinge;

the jaw operating arms bound a space which houses the elastic mechanism and the operating arms;

a pair of opposing guides are provided which are connected with said first ends of said jaw operating arms wherein the jaw operating arms include at the first ends thereof bearings reducing friction when said first ends respectively interact with said pair of opposing guides;

the jaws extend along an axis substantially perpendicular to the axis of symmetry;

the operating arms have the first ends thereof hinged to the first ends of the jaw operating arms and form an acute angle with a concavity thereof facing an interior portion of the space defined by said jaw operating arms; and the operating arms have the second ends thereof hinged to an element slidable axially on at least one additional guide and act on said elastic mechanism, said elastic mechanism operating parallel to the axis of said additional guide.

10. A clamp as claimed in claim 9, which comprises a box structure fixed to the funicular vehicle wherein both the single hinge and the guide are fixed to said box structure.

11. A clamp as claimed in claim 10, wherein the elastic mechanism comprises two precompressed helical springs positioned between a first thrust plate connected with the box structure and a moveable thrust plate positioned on the sliding element, the at least one additional guide being positioned between and parallel to said springs.

12. A clamp as claimed in claim 9, wherein the operation arms for the elastic mechanism are respectively provided for each jaw operating arm.

13. A clamp as claimed in claim 9, wherein the bearings located at the first ends of the jaw operating arms comprise rolling contact bearings.

14. A clamp as claimed in claim 9, wherein the jaw operating arms each have a rectangular cross-section.

15. A clamp as claimed in claim 9, wherein the funicular vehicle comprises a rail vehicle.

16. A clamp as claimed in claim 9, wherein the funicular vehicle comprises an aerial funicular vehicle.

* * * * *